US010480115B2

(12) United States Patent
Henry et al.

(10) Patent No.: US 10,480,115 B2
(45) Date of Patent: Nov. 19, 2019

(54) DEHUMIDIFICATION SYSTEM AND METHOD USED FOR DRYING FIBERS

(71) Applicant: CNH Industrial Canada, Ltd., Saskatoon (CA)

(72) Inventors: James Henry, Saskatoon (CA); Satyanarayan Panigrahi, Saskatoon (CA); Radhey Lal Kushwaha, Saskatoon (CA)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 747 days.

(21) Appl. No.: 14/640,500

(22) Filed: Mar. 6, 2015

(65) Prior Publication Data

US 2015/0252515 A1 Sep. 10, 2015

Related U.S. Application Data

(60) Provisional application No. 61/948,863, filed on Mar. 6, 2014.

(51) Int. Cl.
*F26B 3/00* (2006.01)
*D06F 58/10* (2006.01)

(52) U.S. Cl.
CPC ..... *D06F 58/10* (2013.01)

(58) Field of Classification Search
CPC ..... F26B 21/02; F26B 21/06; F26B 21/08; F26B 21/086; F26B 21/10; F26B 25/06; F26B 25/14; F26B 25/18; F26B 25/22; F26B 9/06; F26B 13/00; F26B 3/02; F26B 3/06; F26B 19/00; D06F 58/10
USPC ..... 34/443, 467, 468, 471, 474, 475, 476, 34/477, 493, 494, 495, 497, 507, 195, 34/196, 202, 50, 7
See application file for complete search history.

(56) References Cited

U.S. PATENT DOCUMENTS 3,359,644 A * 12/1967 Goldman ..... F26B 11/18 108/1
3,628,807 A * 12/1971 Fullington ..... A47F 5/135 280/79.3

(Continued)

FOREIGN PATENT DOCUMENTS

CA 1103918 6/1981
CA 2109292 5/1994

(Continued)

OTHER PUBLICATIONS

PCT/IB2015/000292, International Search Report and Written Opinion, dated Jul. 10, 2015, 11 pages.

*Primary Examiner* — John P McCormack
(74) *Attorney, Agent, or Firm* — Rebecca L. Henkel; Rickard K. DeMille

(57) ABSTRACT

A system and method is provided for drying for fibers or fibrous materials, such as flax, hemp, jute, sisal, banana and coir, among others by dehumidifying the fibers in a temperature and humidity-controlled environment. The dehumidification system does not detrimentally affect the fiber's properties (e.g., strength) by evenly drying the fibers and not subjecting the fibers to repeated high temperature environments, allowing the fibers to be used in more biocomposite applications, such as a reinforcement material. Also the dehumidification method reduces/prevents fiber discoloration, odor, and decomposition.

19 Claims, 2 Drawing Sheets

(56) References Cited

U.S. PATENT DOCUMENTS

| | | | | |
|---|---|---|---|---|
| 3,940,860 | A | 3/1976 | Unterreiner | |
| 4,339,928 | A * | 7/1982 | Guibert | A23L 3/364 34/196 |
| 4,649,653 | A | 3/1987 | Ameling | |
| 4,896,434 | A * | 1/1990 | Fanelli | F26B 5/045 34/259 |
| 5,012,934 | A * | 5/1991 | Newhall | A47J 47/16 211/41.3 |
| 5,673,511 | A * | 10/1997 | Holtkamp, Jr. | A01G 9/028 47/18 |
| 6,158,143 | A * | 12/2000 | Da Cunha | F26B 17/122 34/167 |
| 7,861,864 | B2 * | 1/2011 | Hassell | B65D 1/34 206/386 |
| 2004/0200093 | A1 * | 10/2004 | Wunderlin | D06F 58/28 34/606 |
| 2006/0137725 | A1 | 6/2006 | Yang et al. | |
| 2008/0023426 | A1 * | 1/2008 | Stahl | A47F 3/14 211/126.7 |
| 2014/0109601 | A1 * | 4/2014 | Boarman | F25D 21/12 62/82 |

FOREIGN PATENT DOCUMENTS

| | | | |
|---|---|---|---|
| CA | 2399853 | | 6/2002 |
| CN | 1945180 | | 4/2007 |
| CN | 201731751 | | 7/2010 |
| CN | 202436518 | | 9/2012 |
| CN | 103528346 | | 1/2014 |
| CN | 103528346 | A * | 1/2014 |
| DE | 2902369 | | 8/1980 |
| EP | 0927862 | | 7/1997 |
| GB | 235402 | | 6/1925 |
| GB | 385180 | | 10/1932 |
| SU | 775569 | | 10/1980 |

* cited by examiner

DEHUMIDIFICATION SYSTEM AND METHOD USED FOR DRYING FIBERS

CROSS-REFERENCE TO RELATED APPLICATIONS

This application claims priority from U.S. Provisional Patent Application Ser. No. 61/948,863, filed on Mar. 6, 2014, the entirety of which is expressly incorporated herein by reference.

FIELD OF THE INVENTION

The subject matter disclosed herein relates generally to biocomposite materials and, in particular, to a method and system or apparatus for the dehumidification of fibrous materials for use in the manufacture of biocomposite materials.

BACKGROUND OF THE INVENTION

Fibrous materials such as straw from flax, sisal, hemp, jute and coir, banana, among others, are used in the formation of biocomposite materials, where the fibrous material is combined with another compound, such as a polymer. The fibrous materials can be in the form of raw fibrous materials, or fibers selected from the components of the raw fibrous material, such as the cellulose fibers once separated from the hemicelluloses, lignin and impurities components of the raw fibrous materials. During the preparation and/or processing of the fibers/fibrous materials, these materials are often dried to remove the moisture in the fibrous materials to allow for better processing of the fibrous materials into the biocomposite compositions. Systems and methods that traditionally have and currently are used to dry fibers include: oven drying, microwave drying, microwave-convection drying, microwave-vacuum drying, thin layer drying, among others.

In particular, these traditional and current fiber drying processes, such as oven drying and thin layer drying, the fibers or fibrous materials are placed in enclosures that utilize high temperatures to evaporate moisture from the fibers, which are laid out in a thin layer within the enclosure. This wastes energy and space, disturbs and/or causes damage to the fibers molecular structure, and does not evenly dry the fibers. The prior art drying systems and methods thus negatively affect the fiber's properties, e.g. strength, thereby degrading the fibers usefulness and making them not suited for reinforcement applications in biocomposite materials. Also, the prior art drying systems and methods cause fiber discoloration, the formation of odors in the fibrous materials, and the decomposition of the fibrous materials, all of which are highly undesirable for fibers to be utilized in biocomposite material products.

As a result, a system and method for drying fibers and/or fibrous materials that will not negatively affect the molecular structure of the fibers or fibrous materials, yet provides even and efficient drying of the fibers, is needed.

SUMMARY OF THE INVENTION

According to one aspect of an exemplary embodiment of the present disclosure, a system or apparatus and method is provided for drying for fibers or fibrous materials, such as flax, hemp, jute, sisal, and coir, among others by dehumidifying the fibers in a temperature and humidity-controlled environment. The dehumidification system does not detrimentally affect the fiber's properties (e.g., strength) by evenly drying the fibers and not subjecting the fibers to repeated high temperature environments or conditions, allowing the fibers to be effectively used in more biocomposite applications, such as a reinforcement material. Also, the dehumidification method reduces/prevents fiber discoloration, odor, and decomposition of the fibers.

According to another aspect of an exemplary embodiment of the present disclosure, the system and method does not waste energy and space, and evenly dries the fibers.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
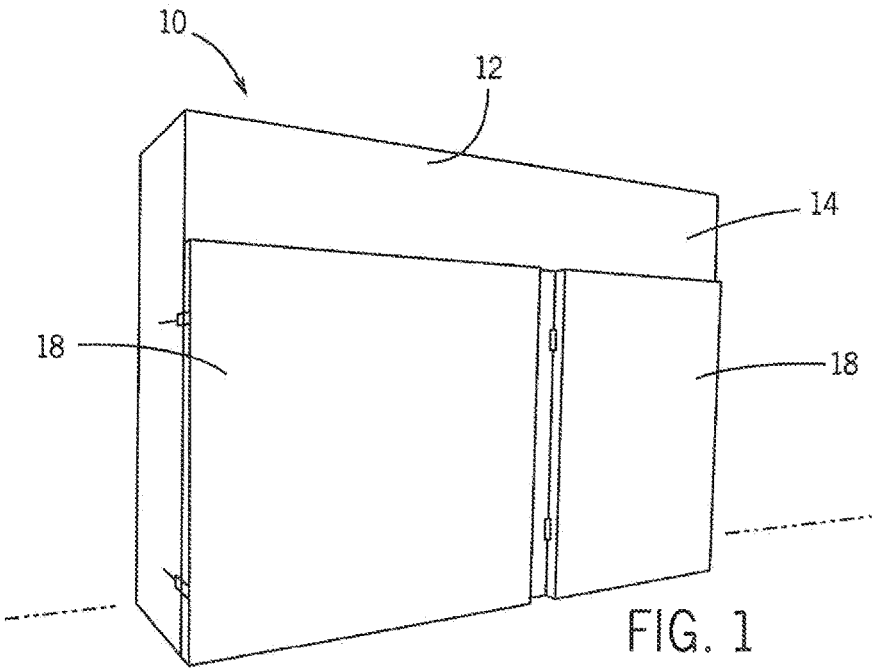
FIG. 1 is a perspective view of an exemplary embodiment of a dehumidification system or apparatus constructed according to the present disclosure.

With reference now to the drawing figure in which like reference numerals designate like parts throughout the disclosure, an exemplary embodiment of a system or apparatus provided for drying various types of fibers and/or fibrous materials in order for use of the fibers/fibrous material in a biocomposite material is illustrated generally at 10 in FIG. 1. This system and method is related to the processes disclosed in co-owned and co-pending U.S. patent application Ser. No. 14/087,326, filed on Nov. 22, 2013, the entirety of which is expressly incorporated by reference herein.

In the illustrated embodiment, the system 10 includes a cabinet 12 formed of any suitable type of material, such as a metal or plastic material. The cabinet 12 includes an insulated enclosure 14 that defines an interior 16. The interior 16 is accessed using a pair of doors 18 that are pivotally or otherwise movably connected to the enclosure 14, though any number of doors 18 can be utilized as desired. A sealing member 20 is optionally disposed on the enclosure 14 around the interior 16 or on the periphery of the doors 18 in order to be engaged between the enclosure 14 and the doors 18 when the doors 18 are in a closed position to effectively seal off the insulated interior 16 of the cabinet 12 from the exterior environment when the doors 18 are closed.

Figure 2:
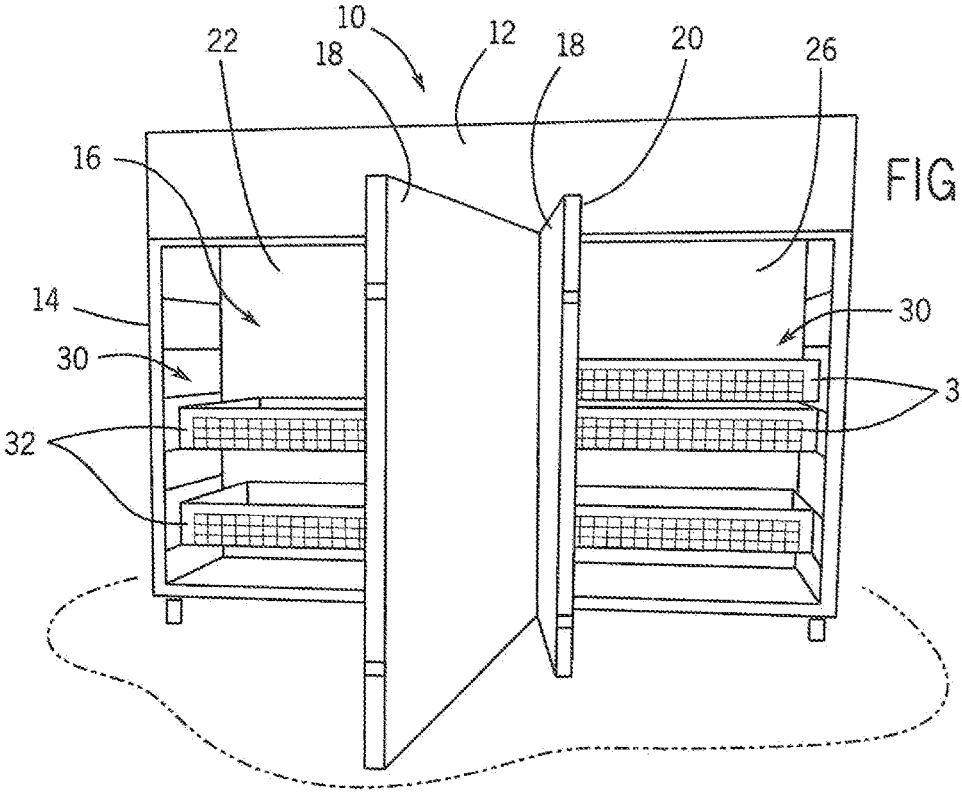
FIG. 2 is a front perspective view of the system of FIG. 1.
Figure 3:
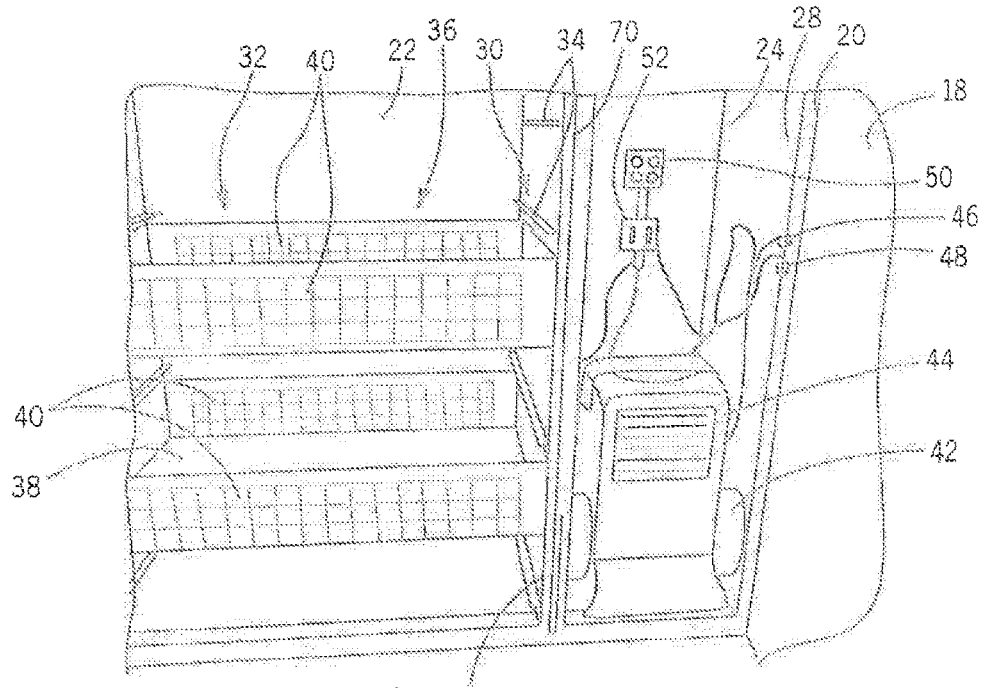
FIG. 3 is a partially broken away perspective view of the interior of the system of FIG. 1.
Figure 4:
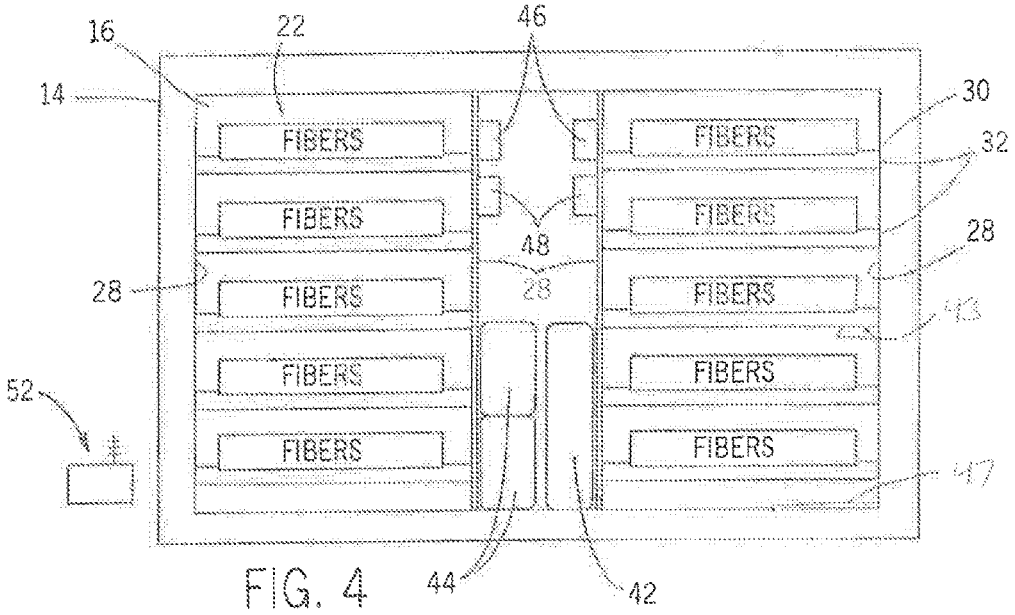
FIG. 4 is a schematic view of the interior of the system of FIG. 1.

Looking now at FIGS. 2-4, the interior 16 of the cabinet 14 includes a number of compartments, in the illustrated exemplary embodiment being first compartment 22, second compartment 24, and third compartment 26, that are defined m the illustrated embodiment by partition walls 28 extending across the interior 16 of the enclosure 14. The first compartment 22 and third compartment 26 are each formed with a rack system 30 or similar supporting structure therein. The rack system 30 enables a number of trays or shelves 32 to be positioned within each compartment 22 and 26 in a spaced configuration across the substantially the entire volume of the compartments 22,26. The rack system 30 can be designed to enable the shelves 32 to be slid inwardly and outwardly relative to the compartments 22,26 on tracks 34, or can be formed as stationary shelves 32 that are immobile, among other design alternatives. In addition, the shelves 32 can be formed as simple flat surfaces, or as in the illustrated exemplary embodiment, can be formed as baskets 36 having a bottom surface 38 and a number of upwardly extending side surfaces 40 that extend above the bottom surface 38. The side surfaces 40 adjacent the partition walls 28 can include suitable structures, such as flanges 41, that are slidably engaged within the tracks 34 to enable the shelves 32 to move with respect to the tracks 34.

Each of the bottom surface 38 and side surfaces 40, or at least the bottom surface 38, is formed as a mesh, perforated or open screen-like material in the illustrated exemplary embodiment. This configuration enables the shelves 32 to hold a fibrous material thereon, while also allowing for air flow through the bottom surface 38 and side surfaces 40 to more effectively contact the fibrous material on the shelves 32. In addition, the bottom surface 38 of the trays or shelves 32 can include a channel 43 or spaced lower surface (not shown) disposed below the bottom surface 38 for collection of the water removed from the fibers that passed downwardly through the bottom surface 38 of the shelves 32. The channel 43 can subsequently direct the water collected therein from the tray 32, such as to one side of the enclosure 22,26, where the water can pass directly to a bottom water collection tray or the bottom surface 47 of the compartment 22,26 for removal of the water from within the enclosure, resulting in faster drying of the fibers.

In one exemplary embodiment, the bottom surface 38 is formed with square apertures approximately 1 cm×1 cm in size to assist in air circulation around and through the fibers on the trays 32, and to enable moisture or water to flow through the apertures while holding the fibers/fibrous materials on the upper surface of the bottom surface 38 of the tray 32. Further, in another exemplary embodiment, the trays 32 can be inclined within the compartments 22,26, such as at a 5 degree angle relative to the horizontal orientation of the cabinet 12, e.g., such that the rear of the shelf 32 is higher than the front of the shelf 32 near the door 18, to further facilitate the flow of collected water through the channels 43 on the trays 26 to the water collection tray 47 without affecting the ability to dry the fibers.

As best shown in FIGS. 3 and 4, in another exemplary embodiment the second compartment 24 is disposed between the first compartment 22 and third compartment 26, and includes disposed therein a number of heaters 42, a number of commercial or industrial dehumidifiers 44, a pair of relative humidity sensors 46 and a pair of thermocouples 48, though the sensors 46 and thermocouples 48 could also be disposed one in each of the compartments 22 and 26. The heater 42 is operable by a suitable power source, such as power outlet 50 operably connected to a conventional residential or commercial power supply, and includes a controller 52 operably connected to the heater 42 in a manner to operate the heater(s) 42 to supply heated air to each of the compartments 22 and 26 through a suitable conduit operably connected between the heater 42 and the first compartment 22 and third compartment 26, which are sealed off from the second compartment 24 by the walls 28 and the seal members 20 disposed around the first and third compartments 22 and 26, either on the enclosure or on the doors 18. The dehumidifiers 44 are also operable by a suitable power source, such as power outlet 50, and the controller 52 also operably connected to the dehumidifiers 44 in a manner to withdraw moisture from each of the first and third compartments 22 and 26 through a suitable conduit 55 operably connected between the dehumidifiers 44 and the first and third compartments 22 and 26. The controller 52 can be operably connected to the sensors 46 and the thermocouples 48, as well as the heater(s) 42 and dehumidifier(s) 44 either by direct wired or wireless connection.

In one exemplary embodiment of the method of operation of the apparatus 10, the fibrous material, whether raw fibrous material or a pre-processed form or component thereof, is placed on the shelves 32 in one or both of the first and third compartments 22 and 26. The doors 18 are closed in order to seal off the first and third compartments 22 and 26 from the exterior environment, and the heater(s) 42 and dehumidifier(s) 44 are operated using the controller 46. The heater(s) 42 and dehumidifier(s) 44 remain shut-off in order to maintain the fibrous material on the shelves 32 at room temperature until the moisture content reaches an equilibrium level, as determined or measured by the sensors 46 and/or thermocouples 48 operably connected to the controller 52 to illustrate the current conditions within the respective compartments 22 and 26. Alternatively, the fibrous material can remain outside of the compartments 22 and 26 until the moisture content reaches equilibrium, at which time the material can be placed on the shelves 32, The doors 18 of the cabinet 12 are then closed, and the dehumidifier(s) 44 are turned on via the controller 52. The temperature in the respective compartments 22 and 26 of the cabinet 12 is increased slightly from room temperature around 35° C.-50° C.) by operating the heater(s) 42 using the controller 52, but not high enough to damage the fiber as in prior art drying systems.

Thermocouples 48 and relative humidity sensors 46 monitor the air temperature and humidity inside the compartments 22 and 26 of the cabinet 12 during this time, such that the operation of the heater(s) 42 and the dehumidifier(s) 44 can be adjusted, if necessary. The combination of increased temperature and dehumidification evenly dries the fibers to the desired moisture content, which can be selected as desired, but in one embodiment is below 2% by weight. Further, as water or moisture is taken out of the sealed environments in each compartment 22 and 26, the associated dehumidifier 44 directs or empties that water into a container or drain (not shown) disposed at or in the back of the compartment 24 of the cabinet 12.

As a result of the drying of the fibrous material using lower heat than prior art methods coupled with dehumidification, it is possible to hold/improve the strength and quality of the fibers or fibrous materials by not damaging the molecular and/or internal structure of the fiber/fibrous materials, thereby allowing the fiber/fibrous material to perform more functions and be used in more biocomposite applications, and to achieve a consistent moisture content across all fibers, as the present system and method does not dehydrate the fibers. The present system 10 and method is an inexpensive drying method with reduced energy consumption and no resulting fiber discoloration, that also reduces and/or prevents fiber odor and the decomposition of the washed fiber during dehumidification. The system 10 and associated method also eliminates exposure of the fibers or fibrous materials to high temperatures before the biocomposite manufacturing stage, as the present dehumidification drying method reduces the number of times the fiber is exposed to high temperatures such that the fibers experience high temperatures only during the biocomposite manufacturing, instead of during the fiber processing (from traditional drying methods) and the biocomposite manufacturing. The system 10 and associated method also has minimal space requirements, and makes it easier to handle and further process the fibers after dehumidification than after traditional methods, as the fibers comes out fluffy and smooth, with no shrinking or binding to each other. Additionally, the system 10 and process is safe and easy to operate on all types of fibers, including flax, hemp, jute, sisal, and coir, among others, and provides complete and close control of the temperature and humidity of the dehumidifying environment within the compartments 22 and 26 to achieve these results.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An apparatus for drying fibrous materials to remove moisture from the fibrous material without damaging the fibrous material, the apparatus comprising:

a) a cabinet having at least one compartment therein defining an interior, and a door for sealing the at least one compartment from an exterior environment;

b) a shelf positioned within the interior of the compartment, wherein the shelf includes a bottom surface including a number of apertures therein; and c) a dehumidifier operably connected to the interior of the at least one compartment; and d) a channel disposed on the shelf below the apertures in the bottom surface and configured to direct moisture flowing through the apertures in the bottom surface away from the shelf.

2. The apparatus of claim 1 further comprising a heating unit operably connected to the interior of the at least one compartment.

3. The apparatus of claim 1 further comprising a controller operably connected to the dehumidifier.

4. The apparatus of claim 3 further comprising at least one temperature sensor disposed within the interior and operably connected to the controller.

5. The apparatus of claim 3 further comprising at least one humidity sensor disposed within the interior and operably connected to the controller.

6. The apparatus of claim 1 wherein the bottom surface is formed of a mesh-like material.

7. The apparatus of claim 1 wherein the shelf is slidably mounted within the interior of the compartment.

8. The apparatus of claim 1 further comprising a number of shelves disposed within the interior of the compartment.

9. The apparatus of claim 1 further comprising:

a) a first compartment defining a first interior and having a first door attached thereto;

b) a second compartment adjacent the first compartment and defining a second interior; and c) a third compartment adjacent the second compartment opposite the first compartment and defining a third interior and having a second door attached thereto.

10. The apparatus of claim 9 wherein the dehumidifier is disposed within the second interior and is operably connected to each of the first interior and the third interior.

11. The apparatus of claim 10 wherein the first interior and the third interior each include a number of shelves disposed therein.

12. The apparatus of claim 11 wherein each of the shelves includes a number of apertures in a bottom surface of each shelf, each aperture having a dimension sufficient to enable moisture to flow therethrough but hold a fibrous material on an upper surface of the bottom surface.

13. The apparatus of claim 12 wherein each of the shelves is disposed at an angle with one end of the shelf higher than the opposite end.

14. A method for drying fibrous materials to remove moisture from the fibrous material without damaging the internal structure of the fibrous material, the method comprising:

a) placing the fibrous material within an apparatus comprising:

i) a cabinet having at least one compartment therein defining an interior, and a door for sealing the at least one compartment from an exterior environment;

ii) a shelf positioned within the interior of the at least one compartment, wherein the shelf consists of a bottom surface including a number of apertures therein and a number of side surfaces extending upwardly from the bottom surface; and iii) a dehumidifier operably connected to the interior of the at least one compartment; and iv) a channel disposed on the shelf below the apertures in the bottom surface and configured to direct moisture flowing through the apertures in the bottom surface away from the shelf; and b) operating the dehumidifier to remove moisture from the material.

15. The method of claim 14 further comprising the step of allowing the humidity in the interior to come to equilibrium prior to operating the dehumidifier.

16. The method of claim 14 further comprising a heater operably connected to the interior of the at least one compartment, and wherein the method further comprises the step of operating the heater concurrently with operating the dehumidifier.

17. The method of claim 16 further comprising at least one humidity sensor and at least one temperature sensor each disposed within the at least one compartment, and a controller operably connected between the at least one temperature and the at least one humidity sensor and the dehumidifier and the heater, and wherein the step of operating the heater concurrently with operating the dehumidifier comprises the steps of:

a) determining the temperature in the at least one compartment from the at least one temperature sensor;

b) determining the humidity in the at least one compartment from the at least one humidity sensor;

c) operating the heater through the controller in response to the temperature determined from the at least one temperature sensor; and d) operating the dehumidifier through the controller in response to the humidity determined from the at least one humidity sensor.

18. The method of claim 17 further comprising the step of ceasing the operation of the heater and the dehumidifier when the humidity sensed by the at least one humidity sensor is about 2% w/w.

19. The method of claim 14 wherein at least one of the side surfaces includes a number of apertures therein.

* * * * *